US010779081B2

(12) United States Patent
Chen

(10) Patent No.: US 10,779,081 B2
(45) Date of Patent: Sep. 15, 2020

(54) METHOD OF GENERATING PREDICTION CURVE FOR ACOUSTIC LOAD OF LOUDSPEAKER

(71) Applicant: TYMPHANY ACOUSTIC TECHNOLOGY (HUIZHOU) CO., LTD., Huizhou, Guangdong Province (CN)

(72) Inventor: Zhiwen Chen, Huizhou (CN)

(73) Assignee: Tymphany Acoustic Technology (Huizhou) Co., Ltd., Huizhou (CN)

( * ) Notice: Subject to any disclaimer, the term of this patent is extended or adjusted under 35 U.S.C. 154(b) by 0 days.

(21) Appl. No.: 16/143,002

(22) Filed: Sep. 26, 2018

(65) Prior Publication Data

US 2019/0098405 A1 Mar. 28, 2019

(30) Foreign Application Priority Data

Sep. 26, 2017 (CN) ..... 2017 1 0880971

(51) Int. Cl.
*H04R 3/04* (2006.01)
*G10L 25/21* (2013.01)
(Continued)

(52) U.S. Cl.
CPC ..... *H04R 3/04* (2013.01); *G10L 25/21* (2013.01); *H04R 1/30* (2013.01); *H04R 29/003* (2013.01); *H04R 2201/34* (2013.01)

(58) Field of Classification Search
CPC ..... H04R 1/30; H04R 1/26; H04R 2201/34; H04R 1/025; H04R 1/026; H04R 1/2888; H04R 1/403; H04R 2201/401; H04R 2400/13; H04R 9/025; H04R 9/06; H04R 1/2811; H04R 1/2826; H04R 2201/028; H04R 2400/03; H04R 2420/07; H04R 31/006; H04R 3/00; H04R 3/12;
(Continued)

(56) References Cited

U.S. PATENT DOCUMENTS 5,793,001 A * 8/1998 Ferralli ..... G10K 11/28 181/155
2005/0175207 A1* 8/2005 Alexander ..... H04R 1/30 381/340

(Continued)

*Primary Examiner* — Lun-See Lao
(74) *Attorney, Agent, or Firm* — Muncy, Geissler, Olds & Lowe, P.C.

(57) ABSTRACT

A method for generating a prediction curve for acoustic load of a loudspeaker, the loudspeaker including a horn and a diaphragm, one end of the horn is defined as a throat, and the outside of the other end of the horn is free space, wherein a sound wave from the diaphragm passes through the throat and gradually diffuses to the free space outside the other end of the horn, includes defining a cross section or a surface, where the cross section is a cross section of the throat, and the surface is a surface of the diaphragm; integrating a sound pressure value of the cross section or the surface to obtain an effective sound pressure, or integrating acoustic energy of the cross section or the surface to obtain a radiated sound power; and generating the prediction curve according to the effective sound pressure or the radiated sound power, where the prediction curve is an acoustic impedance curve or an acoustic power curve.

8 Claims, 13 Drawing Sheets

(51) Int. Cl.
*H04R 1/30* (2006.01)
*H04R 29/00* (2006.01)

(58) Field of Classification Search
CPC . H04R 5/02; H04R 7/12; H04R 7/127; H04R 7/18; H04R 9/022; H04R 1/24; H04R 1/2865; H04R 9/02; H04R 2201/029; H04R 2227/003; H04R 27/00; G10K 11/025; G10K 11/02; G10K 11/004; G10K 11/28; G10K 13/00
USPC ..... 381/98, 423, 340, 61, 186, 96; 181/189, 181/190, 195
See application file for complete search history.

(56) References Cited

U.S. PATENT DOCUMENTS

2007/0278033 A1* 12/2007 Bank ..... H04R 7/045 181/161
2011/0311087 A1* 12/2011 O'Neill ..... H04R 9/02 381/343
2017/0171660 A1* 6/2017 Gaviot ..... H04R 3/08

* cited by examiner

METHOD OF GENERATING PREDICTION CURVE FOR ACOUSTIC LOAD OF LOUDSPEAKER

CROSS REFERENCE TO RELATED APPLICATIONS

This application claims priority to CN 201710880971.3, which was filed on Sep. 26, 2017, and which is herein incorporated by reference.

BACKGROUND

Technical Field

The present disclosure relates to a method for generating a prediction curve for a loudspeaker, and in particular, to a method for generating a prediction curve for acoustic load of a loudspeaker, wherein the prediction curve includes an acoustic impedance curve and/or an acoustic power curve.

Related Art

A loudspeaker is an electro-acoustic transducer. Acoustic load definitely exists when there is acoustic energy. Most loudspeakers work based on air vibration and use air as a medium to transmit sound waves, so as to achieve a sound amplification effect. The acoustic load is actually caused by air.

Further, the acoustic load on a compression drive unit in the loudspeaker is vital because the core function of the compression drive unit is to control and determine air compression and vibration in the loudspeaker. Thus, when the compression drive unit is developed and designed, a separate analog emulation of the acoustic load is extremely necessary.

Currently, in the field of loudspeakers, SPL (Sound Pressure Lever) and IMP (Impedance) simulation curves have been used and the two simulation curves have included the impact of the acoustic load. However, the SPL curve is a frequency response curve under a collective effect of a diaphragm mechanical vibration and the acoustic load, and the IMP curve is an impedance curve under a collective effect of a direct current impedance, a dynamic impedance, an inductive reactance and an acoustic impedance. That is, the conventional SPL and IMP simulation curves are not simulation curves of only the acoustic load, and an analog emulation curve of the acoustic load cannot be extracted from them. Consequently, good suggestions cannot be proposed, based on the SPL and IMP curves, to the development and design of the compression drive unit.

SUMMARY

In view of above, the present disclosure provides a method for generating a prediction curve for acoustic load of a loudspeaker. The loudspeaker includes a horn and a diaphragm, one end of the horn is defined as a throat, and the outside of the other end of the horn is free space. A sound wave from the diaphragm passes through the throat and gradually diffuses to the free space outside the other end of the horn. The method includes the following steps: defining a cross section or a surface, where the cross section is a cross section of the throat, and the surface is a surface of the diaphragm; integrating a sound pressure value of the cross section or the surface to obtain an effective sound pressure, or integrating acoustic energy of the cross section or the surface to obtain a radiated sound power; and generating the prediction curve according to the effective sound pressure or the radiated sound power, where the prediction curve is an acoustic impedance curve or an acoustic power curve.

In a different embodiment, the loudspeaker further includes a phase plug, where the phase plug is located between the diaphragm and the throat, the sound wave from the diaphragm reaches the throat after passing through a path of the phase plug, and the cross section is any cross section between an entrance of the phase plug and an exit of the horn.

In an embodiment, the step of integrating a sound pressure value of the cross section or the surface to obtain an effective sound pressure further includes: integrating the sound pressure value of the cross section or the surface to obtain a sound pressure integral value; dividing the sound pressure integral value by an area of the cross section to obtain the effective sound pressure; integrating a particle velocity on the cross section to obtain a volume velocity; and generating the acoustic impedance curve according to the effective sound pressure and the volume velocity.

The acoustic impedance curve includes an acoustic resistance curve and an acoustic reactance curve, and the method further includes: performing a real number operation on the acoustic impedance curve to generate the acoustic resistance curve; and performing an imaginary number operation on the acoustic impedance curve to generate the acoustic reactance curve.

In another embodiment, the step of integrating acoustic energy of the cross section or the surface to obtain a radiated sound power further includes: calculating acoustic energy passing through the surface in a unit of time; and integrating the acoustic energy of the surface to generate the acoustic power curve.

An electro-acoustic conversion efficiency may be further obtained by using the acoustic power curve. The method includes: providing an input voltage value and a direct current impedance; and dividing a square of the input voltage value by the direct current impedance to obtain a numeric value of an input electrical power; and extracting a maximum value of the acoustic power curve; and comparing the maximum value with the numeric value of the input electrical power to obtain an electro-acoustic conversion efficiency.

In addition to the horn loudspeaker including the horn, the present disclosure also provides a method of generating a prediction curve for acoustic load of a loudspeaker that is applicable to a direct-radiator loudspeaker. The loudspeaker includes a diaphragm, and the method includes the following steps: defining a surface, where the surface is a surface of the diaphragm; integrating a sound pressure value of the surface to obtain an effective sound pressure; and generating the prediction curve according to the effective sound pressure or the radiated sound power, wherein the prediction curve is an acoustic impedance curve or an acoustic power curve.

Similarly, the method for generating the acoustic impedance curve includes: integrating the sound pressure value of the surface to obtain a sound pressure integral value; dividing the sound pressure integral value by an area of the surface to obtain the effective sound pressure; integrating a particle velocity on the surface to obtain a volume velocity; and generating the acoustic impedance curve according to the effective sound pressure and the volume velocity. In this embodiment, the method for generating the acoustic power curve includes: calculating acoustic energy passing through the cross section or the surface in a unit of time; and integrating the acoustic energy of the cross section or the surface to generate the acoustic power curve.

BRIEF DESCRIPTION OF THE DRAWINGS

The present disclosure will become more fully understood from the detailed description given herein below for illustration only, and thus are not limitative of the present disclosure, and wherein.

DETAILED DESCRIPTION

One of the main objectives of the present disclosure is to provide a method of generating a prediction curve for acoustic load of a loudspeaker. The loudspeaker may be a loudspeaker including a horn, a loudspeaker including a compression drive unit (including a horn and a phase plug), and a direct-radiator loudspeaker.

Figure 1:
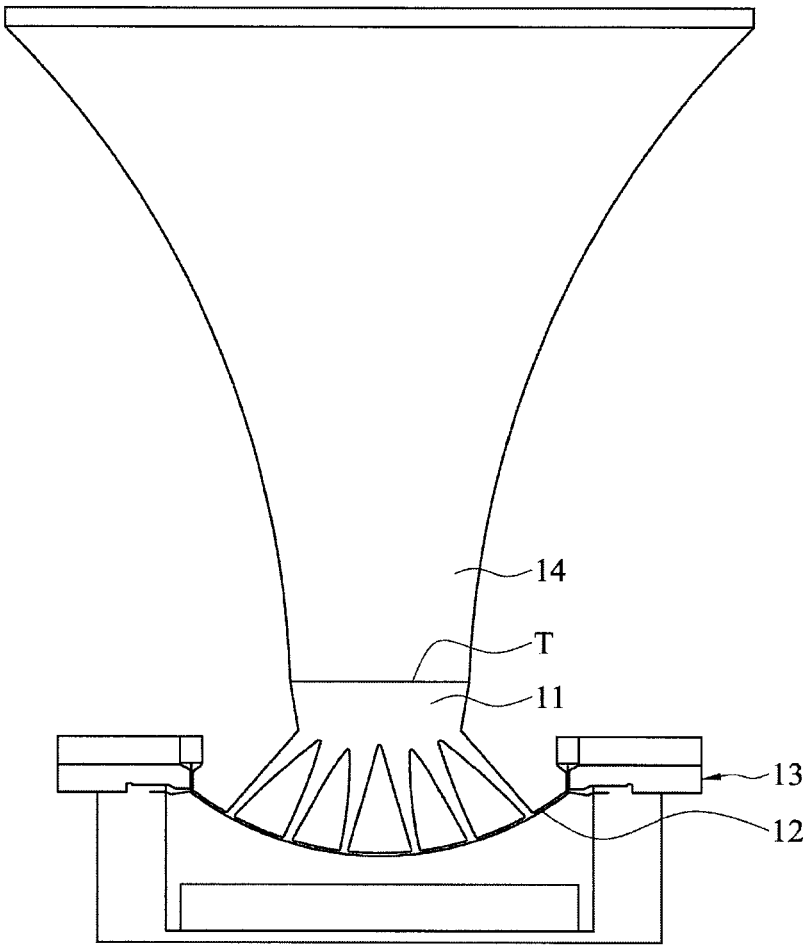
FIG. 1 is a partial schematic diagram of a loudspeaker according to the present disclosure.

The loudspeaker including a compression drive unit and a method for generating a prediction curve for acoustic load of the loudspeaker are described first. Referring to FIG. 1, the loudspeaker includes a horn 14, a phase plug 11, and a diaphragm 12. One end of the horn 14 is defined as a throat T, and the outside of the end of the horn 14 is free space. The phase plug 11 is located between the diaphragm 12 and the throat T. The basic principle of sound producing of the loudspeaker is to energize a voice coil (not labeled) to generate an electromagnetic field, to generate an induced magnetic force by the action of the magnetic field between a magnetic circuit 13 and the voice coil to cause the diaphragm 12 to vibrate, thereby causing surrounding air to produce sound. A sound wave from the diaphragm 12 reaches the throat T after passing through a path of the phase plug 11 and gradually diffuses to the free space outside the other end of the horn 14. Because the principle of sound producing of the loudspeaker is well known in the art, details are not described herein.

Figure 2:
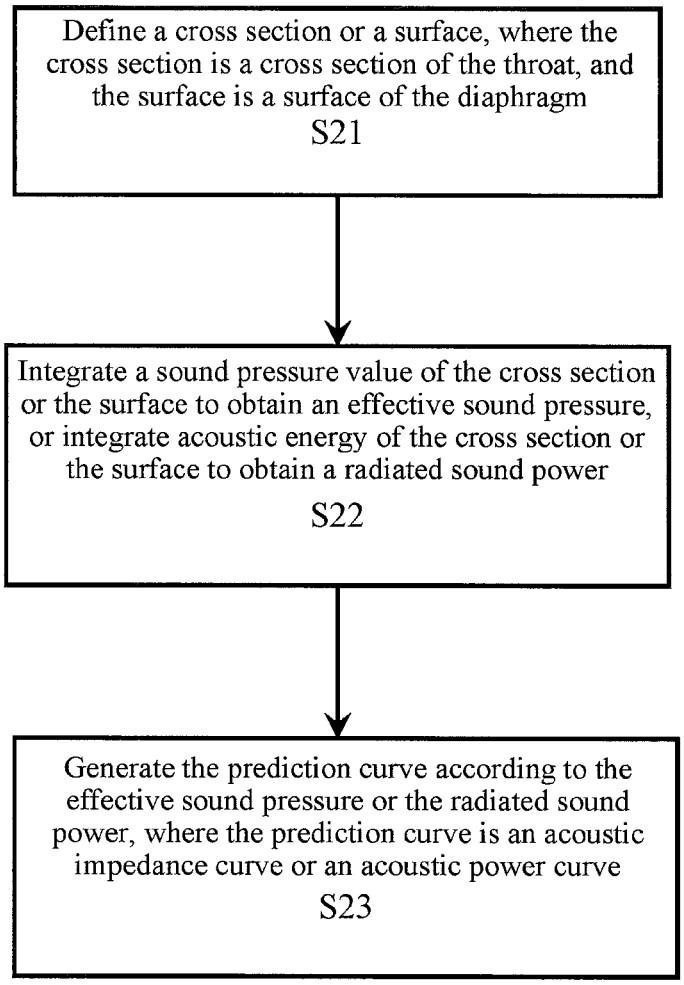
FIG. 2 is a block diagram of an embodiment, according to a method of generating a prediction curve for acoustic load of a loudspeaker of the present disclosure.

As shown in FIG. 2, the method of the present disclosure includes the following steps S21 to S23:

Step S21: define a cross section or a surface, where the cross section is a cross section of the throat, and the surface is a surface of the diaphragm. Further, the cross section may be any cross section between an entrance of the phase plug 11 and an exit of the horn 14. That is, the method provided by the present disclosure may be applicable to a loudspeaker including only a horn, a loudspeaker including only a phase plug, or a loudspeaker including a horn and a phase plug. For a loudspeaker that does not include a horn or a phase plug, it is applicable to define only the surface, namely, the surface of the diaphragm.

Step S22: integrate a sound pressure value of the cross section or the surface to obtain an effective sound pressure, or integrate acoustic energy of the cross section or the surface to obtain a radiated sound power.

Step S23: generate the prediction curve according to the effective sound pressure or the radiated sound power, where the prediction curve is an acoustic impedance curve or an acoustic power curve.

Figure 3:
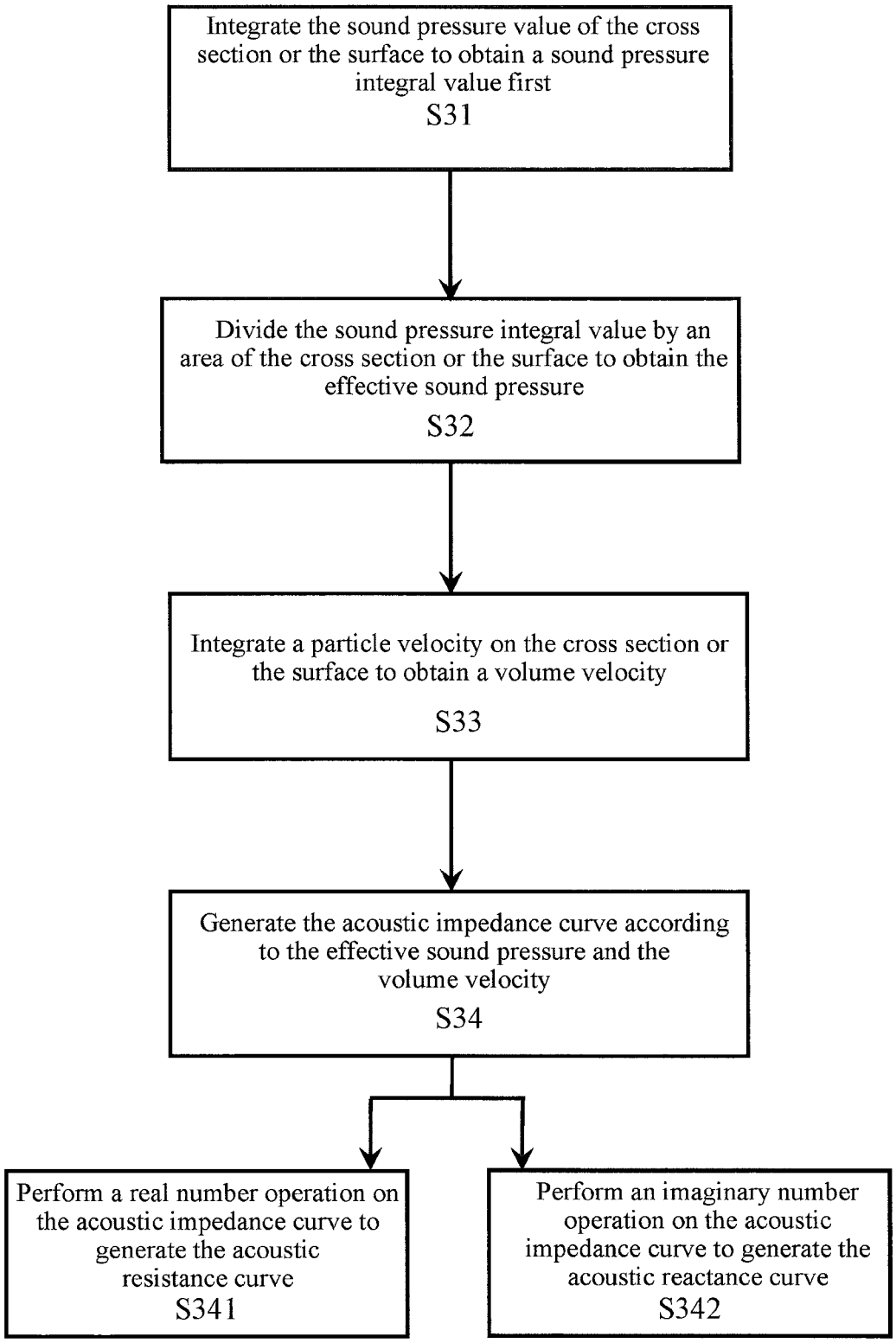
FIG. 3 is block diagram of an embodiment, according to a method of generating an acoustic impedance curve for acoustic load of a loudspeaker of the present disclosure.

Specifically, in an embodiment, the acoustic impedance curve is generated according to the effective sound pressure. Referring to FIG. 3, in the step of integrating a sound pressure value of the cross section or the surface to obtain an effective sound pressure, step S31 is performed first: obtain a sound pressure integral value, and divide the sound pressure integral value by an area of the cross section or the surface to obtain the effective sound pressure (step S32). Then step S33 is performed: integrate a particle velocity on the cross section or the surface to obtain a volume velocity. The last step is S34: generate the acoustic impedance curve according to the effective sound pressure and the volume velocity.

The acoustic impedance curve includes an acoustic resistance curve and an acoustic reactance curve. S341 may be performed to distinguish the acoustic resistance curve, that is, perform a real number operation on the acoustic impedance curve to generate the acoustic resistance curve. S342 may be performed to distinguish the acoustic reactance curve, that is, perform an imaginary number operation on the acoustic impedance curve to generate the acoustic reactance curve.

Figure 4:
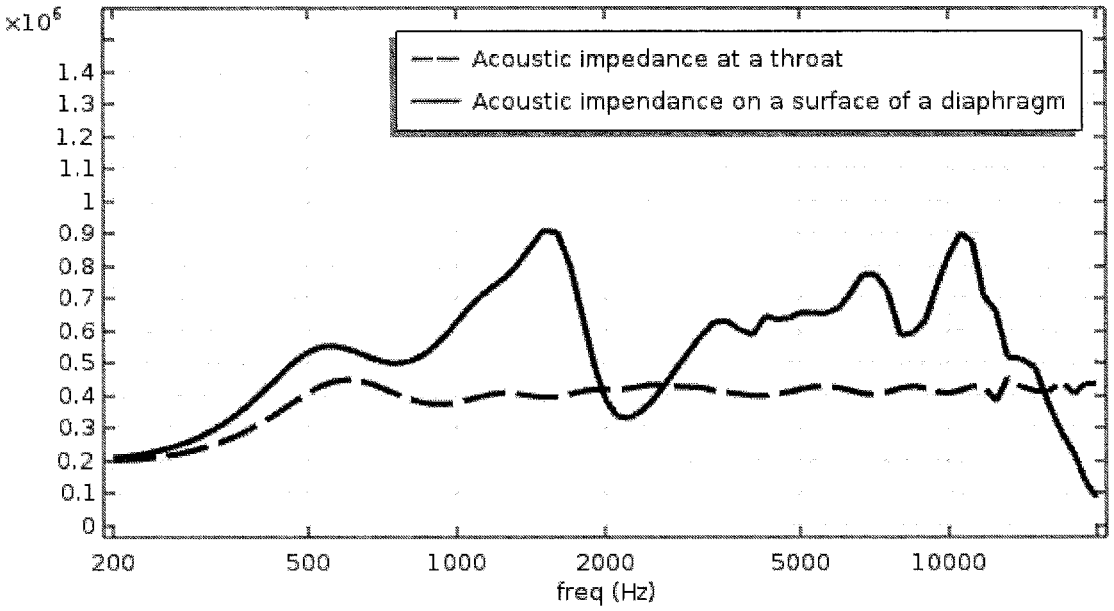
FIG. 4 shows acoustic impedance curves of an embodiment, according to a method of generating a prediction curve for acoustic load of a loudspeaker of the present disclosure.

For example, using the loudspeaker including a compression drive unit as an example, the loudspeaker includes a horn and a phase plug. Acoustic impedance curves (Za) are separately calculated for the cross section at the throat and the surface of the diaphragm. The calculating formula is $Za=p/U$, where the unit is $Pa*s/m^3$. Za is the acoustic impedance, which unit $Pa*s/m^3$ wherein P is the acoustic pressure and U is the acoustic velocity. Through calculation according to the foregoing steps of the method, a result as shown in FIG. 4 may be obtained, that is, the acoustic impedance curves, where the black curve is the acoustic impedance curve calculated for the cross section at the throat, and the light gray curve is the acoustic impedance curve calculated for the surface of the diaphragm.

Figure 5:
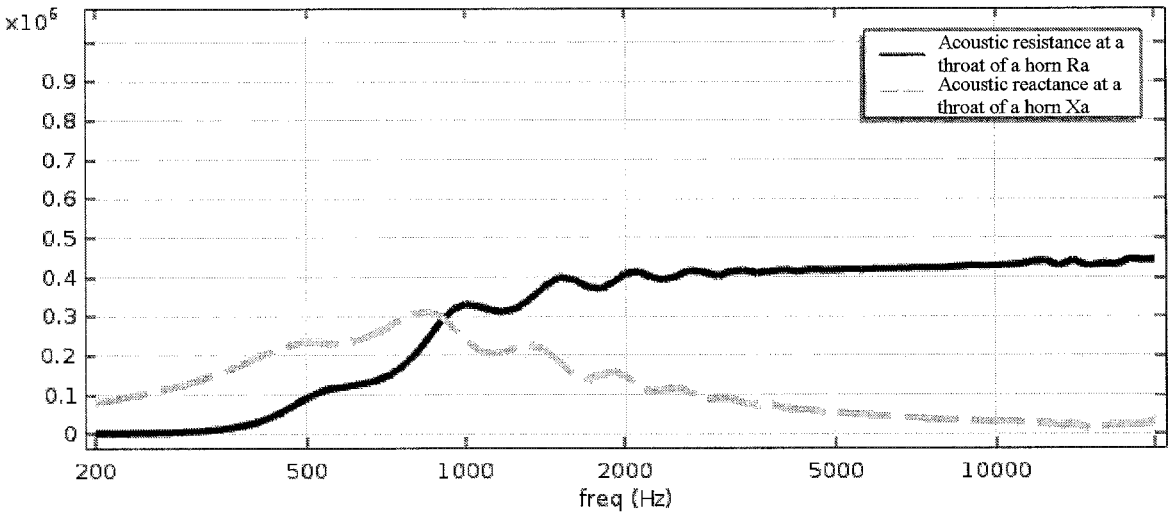
FIG. 5 shows an acoustic resistance curve from an acoustic reactance curve separately according to the acoustic impedance curve of FIG. 4.

Further, the present disclosure also uses a mathematical operation on complex numbers. As described above, the real number operation (Ra=Real(Za)) and the imaginary number operation (Xa=Imag(Za)) are performed on the acoustic impedance curve, so as to respectively obtain the acoustic resistance curve and the acoustic reactance curve. Using the loudspeaker including a compression drive unit as an example, the loudspeaker includes a horn and a phase plug, and the calculation on the cross section at the throat results in curves shown in FIG. 5.

Figure 6:
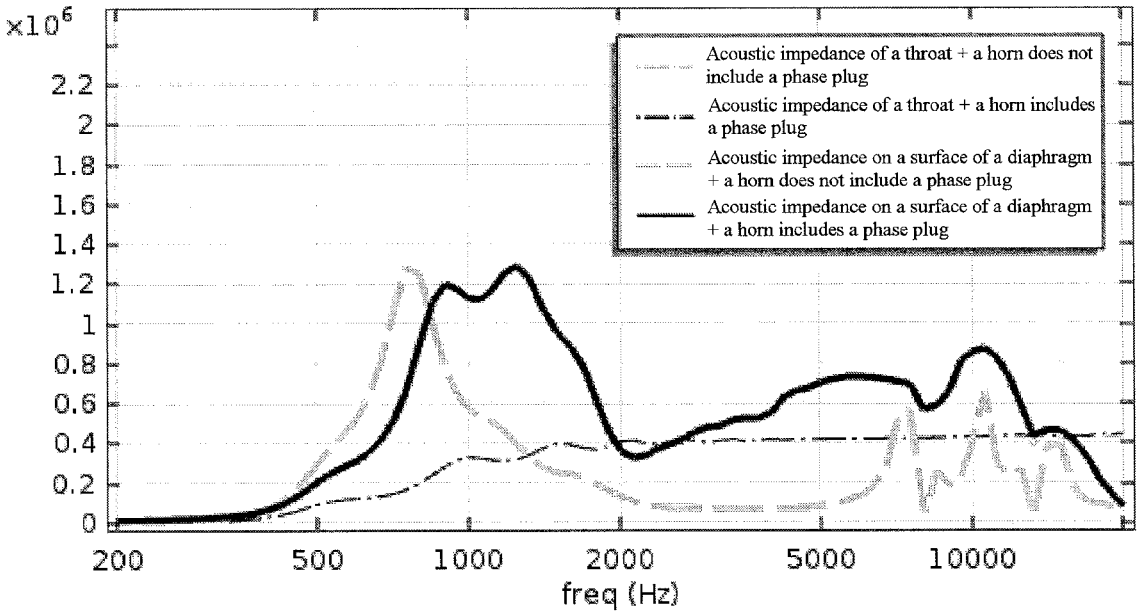
FIG. 6 shows acoustic impedance curves of a cross section at a throat of the horn loudspeaker or a surface of a diaphragm of the horn loudspeaker, according to whether a horn loudspeaker includes a phase plug.

The method of the present disclosure may also be applicable to the horn loudspeaker that does not include a phase plug. FIG. 6 shows four different acoustic impedance curves obtained through calculation on the cross section at the throat or the surface of the diaphragm when the horn loudspeaker includes or does not include a phase plug. Emulation shows that acoustic impedance curves of the throat are identical when the loudspeaker includes and does not include the phase plug, which means that the acoustic impedance of the throat is decided by only the shape of the horn and is irrelevant to the phase plug.

Figure 7:
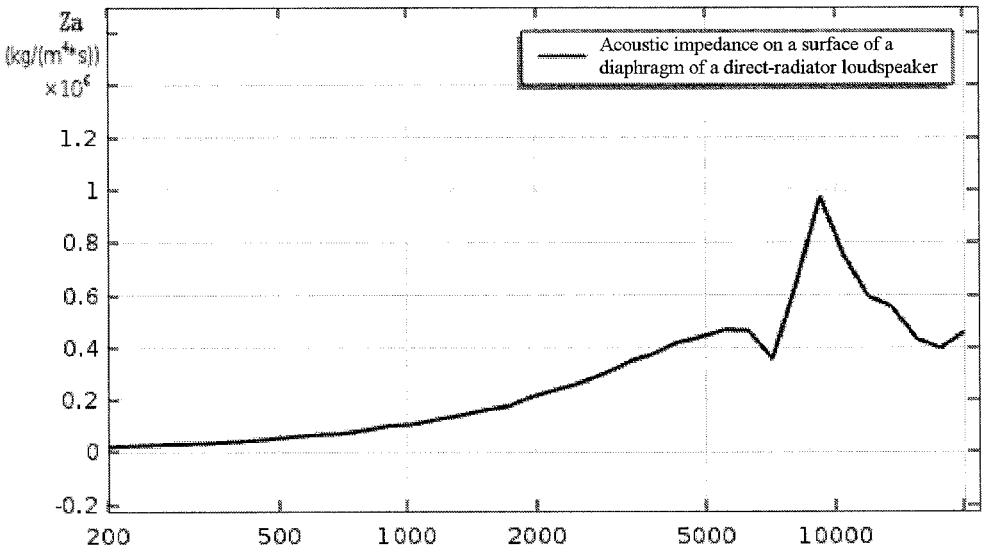
FIG. 7 shows, according to a direct-radiator loudspeaker, an acoustic impedance curve obtained through calculation on a surface of a diaphragm of the direct-radiator loudspeaker.

The method of the present disclosure may also be applicable to a direct-radiator loudspeaker that dos not include a phase plug or a horn. FIG. 7 shows, according to a direct-radiator loudspeaker, an acoustic impedance curve obtained through calculation on a surface of a diaphragm of the direct-radiator loudspeaker.

Figure 8:
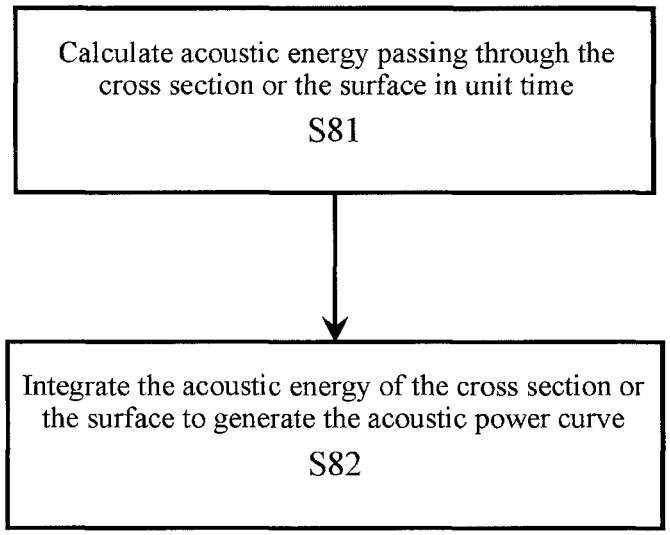
FIG. 8 is a block diagram of an embodiment, according to a method for generating an acoustic power curve for acoustic load of a loudspeaker of the present disclosure.

In the present disclosure, an acoustic power curve is generated according to the radiated sound power. Further, in step S22 of FIG. 2, the step of integrating the acoustic energy of the cross section or the surface to obtain the radiated sound power may be further refined, as shown in FIG. 8, to include step S81: calculate acoustic energy passing through the cross section or the surface in a unit of time; and step S82: integrate the acoustic energy of the cross section or the surface to generate the acoustic power curve.

Figure 9:
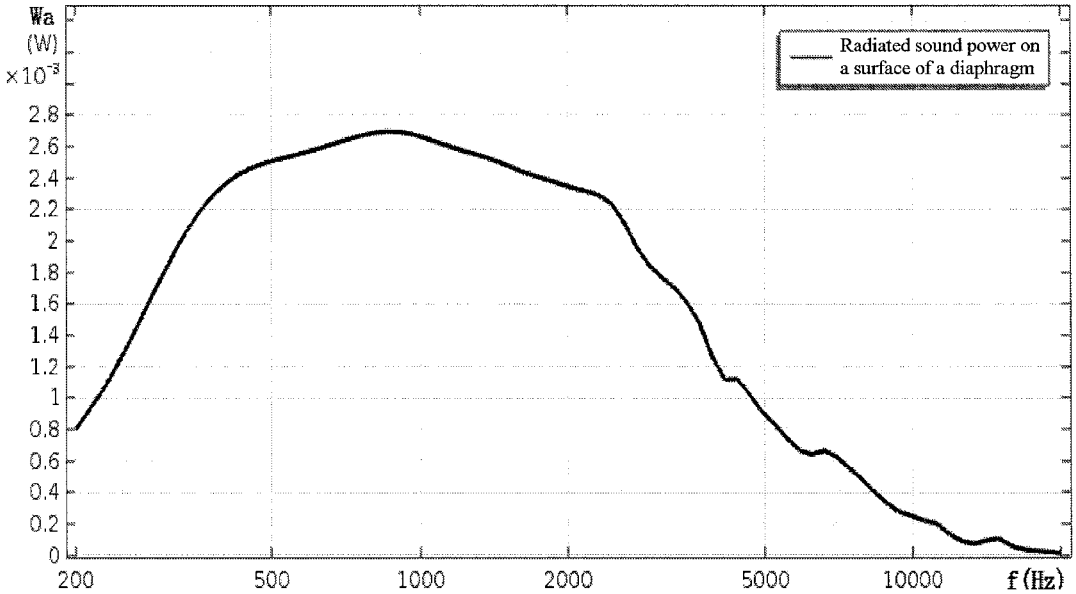
FIG. 9 shows an acoustic power curve of an embodiment, according to a method for generating an acoustic power curve for acoustic load of a loudspeaker of the present disclosure.
Figure 10:
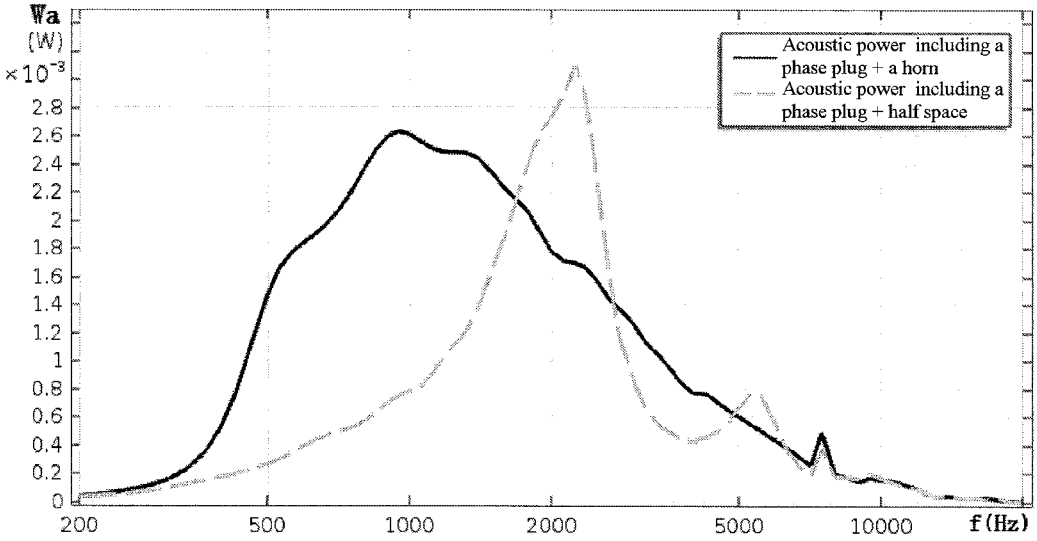
FIG. 10 separately shows acoustic power curves calculated when a phase plug is included and when a horn is included or when a horn is not included.
Figure 11:
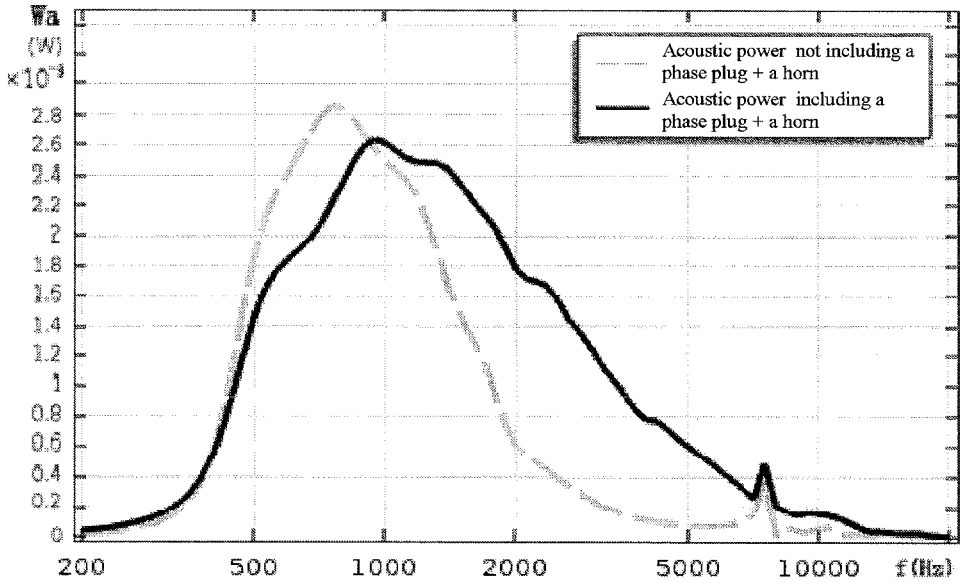
FIG. 11 separately shows acoustic power curves calculated when a horn is included and when a phase plug is included or when a phase plug is not included.

For example, an average acoustic energy I passing through an area S in a vertical sound propagation direction in a unit of time (sound intensity) is an average sound power, namely, Wa=I*S, where the unit is W. Therefore, the radiated sound power can be obtained by integrating the sound intensity on the vibrating surface of the diaphragm. The calculation result is an acoustic power curve (Wa curve) as shown in FIG. 9. FIG. 10 separately shows acoustic power curves (Wa curves) calculated when the loudspeaker includes a phase plug and includes a horn or does not include a horn. FIG. 11 separately shows acoustic power curves (Wa curves) calculated when the loudspeaker includes a horn and includes a phase plug or does not include a phase plug.

Figure 12:
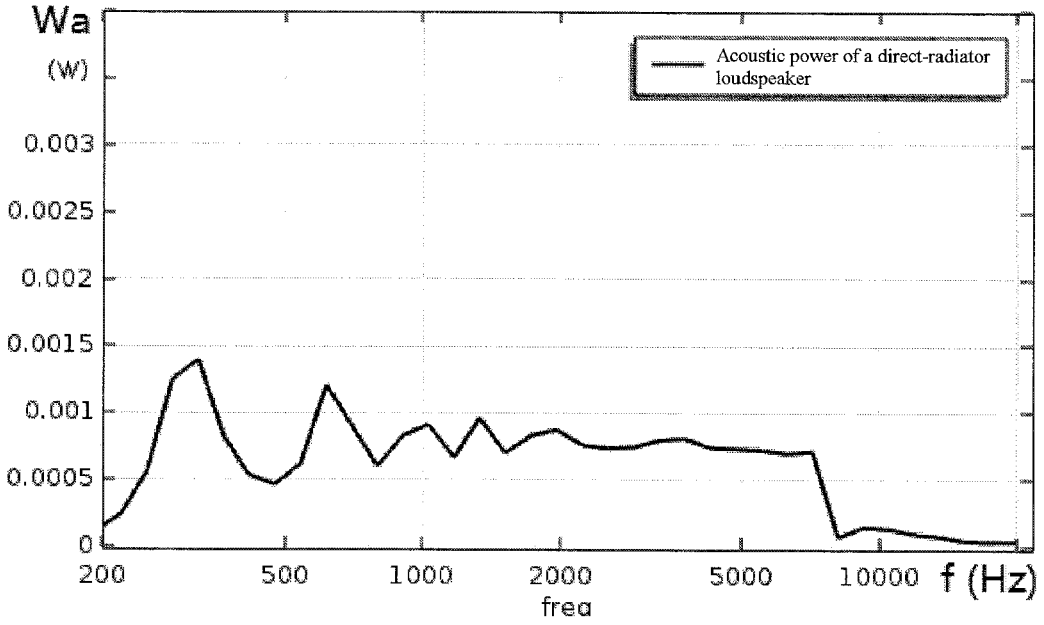
FIG. 12 shows an acoustic power curve calculated when neither a horn nor a phase plug is included.

FIG. 12 shows an acoustic power curve calculated when the loudspeaker does not include a horn or a phase plug.

Figure 13:
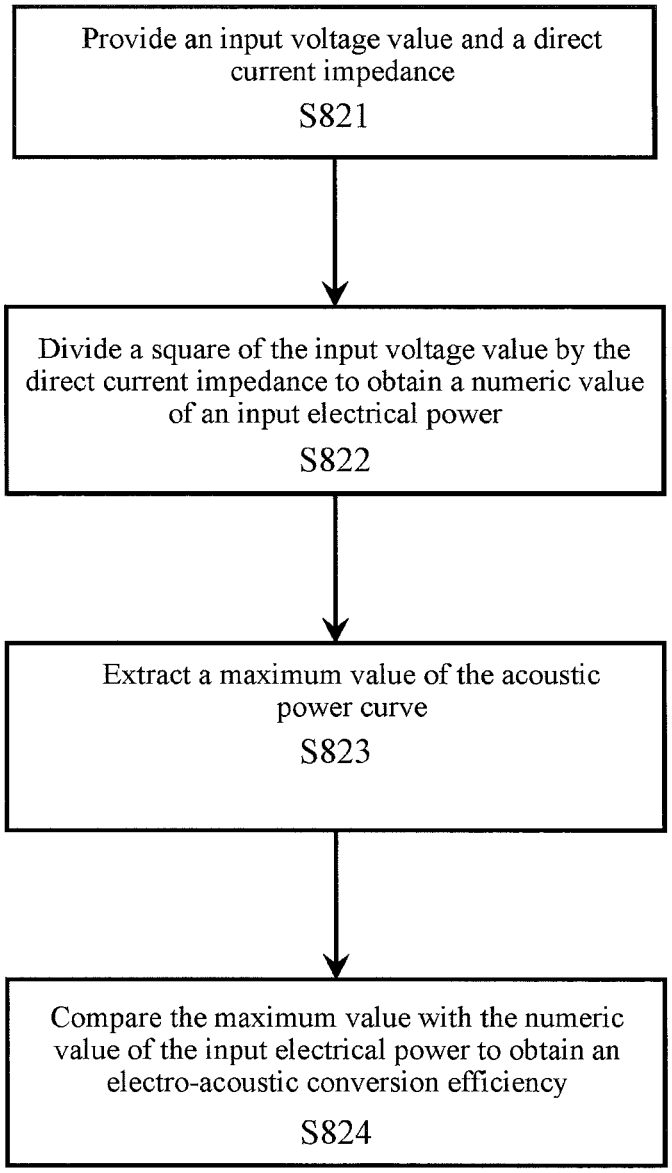
FIG. 13 is a block diagram of an embodiment, according to a method of generating an acoustic power curve for acoustic load of a loudspeaker of the present disclosure and calculating an electro-acoustic conversion efficiency.

An electro-acoustic conversion efficiency may be further obtained in the present disclosure according to the acoustic power curve. Referring to FIG. 13, the process includes step S821: provide an input voltage value and a direct current impedance; step S822: divide a square of the input voltage value by the direct current impedance to obtain a numeric value of an input electrical power; step S823: extract a maximum value of the acoustic power curve; and step S824: compare the maximum value with the numeric value of the input electrical power to obtain an electro-acoustic conversion efficiency.

For example, according to the acoustic power curve of FIG. 9, using an input voltage of 0.283 V (volt) and a direct current impedance of 5.6Ω (ohm) as an example, an input electrical power of $Wi=0.283^2/50.6=14.2$ mW may be obtained through calculation. Then, a maximum value of the acoustic power curve, namely, 2.7 mW is extracted. The maximum value is compared with the numeric value of the input electrical power, namely, $\eta=Wa/Wi=2.7/14.2=19\%$, that is, the electro-acoustic conversion efficiency of the embodiment of FIG. 9 is 19%.

In another embodiment, according to the acoustic power curve of FIG. 12, using an input voltage of 1.414V and a direct current impedance of 3.55 ohm as an example, an input electrical power of $Wi=1.414^2/30.55=0.563$ W may be obtained through calculation. Then, a maximum value of the acoustic power curve, namely, 0.0014 W (Watt) is extracted. The maximum value is compared with the numeric value of the input electrical power, namely, $\eta=Wa/Wi=0.0014/0.563=0.25\%$, that is, the electro-acoustic conversion efficiency of the embodiment of FIG. 12 is 0.25%. Therefore, the electro-acoustic conversion efficiency of the direct-radiator loudspeaker is lower than the electro-acoustic conversion efficiency of the compression drive unit.

In different embodiments, different input voltages and direct current impedances may be selected as calculation parameters. Though the acoustic power values obtained through calculation are different, the efficiency (a ratio of an electrical power to an acoustic power) is the same. Thus, such a prediction curve may have a significant reference value for designers of the loudspeaker.

Two most prominent features of the compression drive unit are the internal phase plug structure and external horn. In essence, the phase plug and the horn are to match the acoustic impedance from the air compressed and vibrating at the diaphragm to the free field by changing the acoustic load. Therefore, an analog emulation of the acoustic load is extremely necessary.

Although the present disclosure has been disclosed above in the embodiments, they are not intended to limit the present disclosure. Any person skilled in the art can make some modifications and variations without departing from the spirit and scope of the present disclosure. Therefore, the protection scope of the present disclosure is subject to the protection scope in claims.

What is claimed is:

1. A method of generating a prediction curve for acoustic load of a loudspeaker, wherein the loudspeaker comprises a horn and a diaphragm, one end of the horn is defined as a throat, an outside of an other end of the horn is free space, and a sound wave from the diaphragm passes through the throat and gradually diffuses to the free space outside the other end of the horn, the method comprising:

defining a cross section or a surface, wherein the cross section is a cross section of the throat, and the surface is a surface of the diaphragm;

calculating an integration of a sound pressure value of the cross section or the surface to obtain an effective sound pressure, or calculating an integration of acoustic energy of the cross section or the surface to obtain a radiated sound power; and generating the prediction curve according to the effective sound pressure or the radiated sound power, wherein the prediction curve is an acoustic impedance curve or an acoustic power curve, wherein the acoustic impedance curve is obtained by:

calculating an integration of the sound pressure value of the cross section or the surface to obtain a sound pressure integral value;

dividing the sound pressure integral value by an area of the cross section or the surface to obtain the effective sound pressure;

calculating an integration of a particle velocity on the cross section or the surface to obtain a volume velocity; and generating the acoustic impedance curve according to the effective sound pressure and the volume velocity, and wherein the acoustic power curve is obtained by:

calculating acoustic energy passing through the cross section or the surface in a unit of time; and calculating an integration of the acoustic energy of the cross section or the surface to generate the acoustic power curve.

2. The method according to claim 1, wherein the loudspeaker comprises a phase plug, the phase plug is located between the diaphragm and the throat, the sound wave from the diaphragm reaches the throat after passing through the phase plug and gradually diffuses to the free space outside the other end of the horn, and the cross section may be any cross section between an entrance of the phase plug and an exit of the horn.

3. The method according to claim 1, wherein the acoustic impedance curve comprises an acoustic resistance curve and an acoustic reactance curve, the method further comprising:

performing a real number operation on the acoustic impedance curve to generate the acoustic resistance curve.

4. The method according to claim 1, wherein the acoustic impedance curve comprises an acoustic resistance curve and an acoustic reactance curve, the method further comprising:

performing an imaginary number operation on the acoustic impedance curve to generate the acoustic reactance curve.

5. The method according to claim 1, further comprising:

providing an input voltage value and a direct current impedance; and dividing a square of the input voltage value by the direct current impedance to obtain a numeric value of an input electrical power.

6. The method according to claim 5, further comprising:

extracting a maximum value of the acoustic power curve; and comparing the maximum value with the numeric value of the input electrical power to obtain an electro-acoustic conversion efficiency.

7. A method of generating a prediction curve for acoustic load of a loudspeaker, wherein the loudspeaker comprises a diaphragm, the method comprising:

defining a surface, wherein the surface is a surface of the diaphragm;

calculating an integration of a sound pressure value or acoustic energy of the surface to obtain an effective sound pressure or a radiated sound power; and generating the prediction curve according to the effective sound pressure or the radiated sound power, wherein the prediction curve is an acoustic impedance curve or an acoustic power curve, wherein the acoustic impedance curve is obtained by:

calculating an integration of the sound pressure value of the surface to obtain a sound pressure integral value;

dividing the sound pressure integral value by an area of the surface to obtain the effective sound pressure;

calculating an integration of a particle velocity on the surface to obtain a volume velocity; and generating the acoustic impedance curve according to the effective sound pressure and the volume velocity, and wherein the acoustic power curve is obtained by:

calculating acoustic energy passing through the surface in a unit of time; and calculating an integration of the acoustic energy of the surface to generate the acoustic rower curve.

8. The method according to claim 7, wherein said calculating the integration of the sound pressure value of the cross section or the surface to obtain an effective sound pressure comprises:

calculating an integration of the sound pressure value of the cross section or the surface to obtain a sound pressure integral value;

dividing the sound pressure integral value by an area of the cross section or the surface to obtain the effective sound pressure;

calculating an integration of a particle velocity on the cross section or the surface to obtain a volume velocity; and generating the acoustic impedance curve according to the effective sound pressure and the volume velocity.

* * * * *